United States Patent [19]

Wernicke

[11] Patent Number: 4,925,778

[45] Date of Patent: May 15, 1990

[54] PROCESS FOR THE RAPID DEVELOPMENT OF COLOR MATERIALS

[75] Inventor: Ubbo Wernicke, Cologne, Fed. Rep. of Germany

[73] Assignee: Agfa-Gevaert Aktiengesellschaft, Leverkusen, Fed. Rep. of Germany

[21] Appl. No.: 321,967

[22] Filed: Mar. 10, 1989

[30] Foreign Application Priority Data

Mar. 26, 1988 [DE] Fed. Rep. of Germany ..... 3810348

[51] Int. Cl.[5] ..... G03C 7/20

[52] U.S. Cl. ..... 430/383; 430/375; 430/376; 430/380; 430/421; 430/433; 430/963

[58] Field of Search ..... 430/375, 376, 380, 383, 430/421, 433, 963, 419, 427, 448, 456

[56] References Cited

U.S. PATENT DOCUMENTS 3,637,389 1/1972 Hofman ..... 430/963
3,694,209 9/1972 Schwieubacher ..... 430/963
4,363,869 12/1982 Hutchinson, Jr. ..... 430/427

FOREIGN PATENT DOCUMENTS 0246624 11/1987 European Pat. Off. ..... 430/963

*Primary Examiner*—Hoa Van Le

[57] ABSTRACT

A process for the rapid development of imagewise exposed silver halide recording materials which contain on a layer support at least three light sensitive silver halide emulsion layers of different spectral sensitivity, with which a cyan coupler, a magenta coupler and a yellow coupler are in each case spectrally associated, comprising the following treatment steps:

1. treatment of the photographic material with a solution I of a color developing agent or a salt thereof at pH 1 to 8 over a period of 1 to 10 seconds,
2. treatment of the photographic material impregnated with the developing agent with an alkali-containing solution II at pH 10 to 14 over a period of 1 to 10 seconds.

produces maximum color densities of the kind otherwise only obtained by conventional development over a period of 45 seconds.

8 Claims, No Drawings

PROCESS FOR THE RAPID DEVELOPMENT OF COLOR MATERIALS

The invention relates to a process which is particularly suitable for the rapid development of photographic materials with a high content of silver-chloride.

The formation of colour-photographic images by the imagewise coupling of the developer oxidation product with coupler molecules is well-known. In this process cyan, magenta and yellow partial images are usually produced which combine to form the final coloured image. The developers are generally primary aromatic amino compounds which are converted to form the developer oxidation product in the exposed silver halide areas.

The silver halides which may be employed are silver bromide, silver bromoiodide, silver chloride, silver chlorobromide and silver chlorobromoiodide, silver halide emulsions with a high chloride content or even pure silver chloride emulsions being adopted to an ever-increasing extent for colour negative paper since such emulsions with a high content of chloride have a number of advantageous properties. Thus their lower intrinsic sensitivity to visible light can be utilised for producing materials without yellow filter layers, which are for example indispensable in highly sensitive materials such as negative films or reversal films. Furthermore, the use of silver halide emulsions containing high quantities of chloride considerably reduces the development times required since the chloride ions released during development do not have such an inhibitive effect as bromide ions.

The use of silver halide emulsions with a chloride content of >95 mol% in combination with bromide-free colour development baths has enabled the development time of colour papers to be reduced from 210 to 45 seconds (RA 4 Process, Kodak 2001 paper).

By the use of highly active developers of the Agfa 95 CD type it has also become possible to achieve the same development time with conventional colour papers based on silver bromide emulsions.

A further reduction in the development time, while being desirable and by all means conceivable, is limited by factors inherent in the system of development employed.

When the photographic material is immersed in a highly active developer solution the development of the uppermost colour layer of the colour material immediately begins. The halide released during the reduction of the silver halide penetrates into the underlying emulsion layer together with the developer solution and impedes the development thereof. The third and bottommost emulsion layer of a material containing three silver halide emulsion layers of different spectral sensitivities suffers particularly in this process.

The asset of the development of this layer is delayed by three factors:

1. The path of diffusion of the developing agent is the longest.
2. The concentration of the developing agent is not as high owing to the consumption thereof by the overlying layers.
3. The presence of large quantities of halide from layers I and II, which reach layer III at the same time as the developing agent has a correspondingly inhibitive effect on the development process.

These disadvantages are particularly noticeable in rapid processing operations with extremely short development times (e.g. <20 secs.) and development by conventional methods thus becomes more difficult, if not impossible.

It has now been found that a special development process not only allows the abovementioned disadvantages to be overcome but also produces additional advantages for practical use.

The invention relates to a process for the rapid development of imagewise exposed silver halide materials which contain on a layer support at least three light-sensitive silver halide emulsion layers of different spectral sensitivity with which a cyan coupler, a magenta coupler and a yellow coupler are in each case spectrally associated, comprising the following treatment steps:

1. treatment of the photographic material with a solution I of a developing agent or a salt thereof at pH 1 to 8 over a period of 1 to 10 seconds,
2. treatment of the photographic material impregnated with the developing agent with a alkali-containing solution II at pH 10 to 14 over a period of 1 to 10 seconds.

The total development time using the two baths described above is thus considerably less than 45 seconds. In the first bath containing the developing agent the pH value is low so that no development or only a small degree of development takes place thus allowing the developing agent to diffuse into the bottommost layer of the photographic material without being hindered in any way by the development process. The second bath contains alkali to increase the pH value; owing to the rapid diffusion of the hydroxyl ions development can begin at the same time in all layers.

The pH value of developer solution I is preferably 3.5 to 6.5; that of developer solution II is 12 to 14.

In addition to the extremely short development time the use of two development baths of the abovementioned kind also has advantages with respect to the practically unlimited stability of developer solution I since at low pH values the influence of atmospheric oxygen, which promotes autooxidation, is to a large extent eliminated. Further advantages are to be found in the almost complete non-dependence of this rapid development process on the concentration of the solutions I and II employed and in the provision of a virtually overflow-free mode of operation.

In view of the very short treatment time of the photographic material with the two solutions it is also possible to carry out a so-called single application with moistened rollers or pressure cylinders.

A solution of NaOH, KOH, tripotassium phosphate or a mixture of these substances can for example be used as the alkali bath.

It is in some cases appropriate to adjust the sensitometric results by adding to solution I small quantities of substances which influence the solubility product of the silver halide, such as for example KCl, KBr, KI or stabilisers.

When using the present process in a continuous mode of operation it may also be advantageous to add wetting agents and complexing agents to solutions I and II which accelerate the penetration of the solutions into the emulsion layers or which intercept the calcium ions present in the gelatin and the water.

Suitable complexing agents for complexing calcium ions are for example aminpolycarboxylic acids which are well-known per se. Typical examples of such aminopolycarboxylic acids are nitrotriacetic acid, ethylenediamine tetracetic acid (EDTA), 1,3-diamino-2-hydroxypropyltetraacetic acid, diethylenetriamine pentaacetic acid, N,N'-bis-(2-hydroxybenzyl)-ethylenediamine-N,N'-diacetic acid, hydroxyethylethylenediamine triacetic acid, cyclohexanediaminotetraacetic acid and aminomalonic acid.

Further calcium complexing agetns are polyphosphates, phosphonic acids, aminopolyphosphonic acids and hydrolysed polymaleic anhydride, for example sodium hexametaphosphate, 1-hydroxyethane-1,1-diphosphonic acid, aminotrimethylene-phosphonic acid and ethylenediaminetetramethylene-phosphonic acid, 1-Hydroxyethane1,1-diphsophonic acids also acts as an iron complexing agent.

It is also advantageous to add iron complexing agents to the two developer solutions.

Special iron complexing agents are for example 4,5-dihydroxy-1,3-benzenedisulphonic acid, 5,6-dihydroxy-1,2,4-benzenetrisulphonic acid and 3,4,5-trihydroxybenzoic acid.

For the complexing of calcium about 0.2 to about 1.8 mol of a calcium complexing agent are preferably used per mol of developing agent.

The iron complexing agent is used in quantities of about 0.02 to about 0.2 mol per mol of developing agent.

Particularly suitable primary aromatic amino developing agents are p-phenylenediamine and in particular N,N-dialkyl-p-phenylenediamines in which the alkyl groups and the aromatic nucleus are substituted or unsubstituted. Examples of such compounds are N,N-diethyl-p-phenylenediamine hydroxchloride, 4-N,N-diethyl-2-methyl-p-phenylenediamine hydrochloride, 4-(N-ethyl-N-2-methanesulphonylaminoethyl)-2-methyl-p-phenylenediaminesesquisulphate monohydrate, 4-(N-ethyl-N-2-hydroxyethyl)-2-methyl-p-phenylenediamine sulphate and 4-N,N-diethyl-2,2'-methanesulphonylaminoethyl-p-phenylenediamine hydrochloride.

Preferably the developing agent is applied in an amount of 5 to 100 g/l, particularly in an amount of 5 to 30 g/l.

Furthermore it may be appropriate to add whitening agents, white couplers and antioxidising substances. Suitable antioxidising agents are for example hydroxylamine and diethylhydroxylamine as well as sulphites which are preferably used in a quantity of up to 5 g/l.

Suitable additional constituents are optical brighteners, lubricants, for example polyalkylene glycols, surfactants, stabilisers, for example heterocyclic mercapto compounds or nitrobenzimidazole and agents for establishing the required pH value. The developer solution can also contain less than 5 g of benzyl alcohol; it preferably contains no benzylalcohol.

The silver halide emulsion layers of the photographic recording material which is subjected to the above-described rapid development process should contain at least 80, and preferably at least 95 mol% of chloride.

The layer containing the cyan coupler is usually red-sensitive, that containing the magenta coupler is usually green-sensitive and that containing the yellow coupler is usually blue-sensitive.

The temperatures suitable for the rapid development process lie within the range of 20° to 40° C.

The ready-to-use solutions can be prepared from the individual constituents or from so-called concentrates, the individual constituents being dissolved in the concentrates in considerably higher concentrations. The concentrates are adjusted in such a manner that a so-called replenisher, i.e. a solution which has somewhat higher concentrations of the individual constituents than the ready-to-use solution, can be prepared therefrom. This replenisher can on the one hand be used for the preparation of a ready-to-use solution, for which purpose it is diluted further and a starter, preferably KCl is added, or it can, on the other hand be continuously added to a developer solution in use in order to replace the chemicals consumed during development or discharged from the developer solution as a result of overflow or entrained with the developed material. Chloride ions usually do not have to be added except in the case of freshly prepared developer since chloride ions are usually liberated from the photographic material as a result of the development.

With the aid of the development baths according to the invention it is possible to develop a colour-photographic negative paper, the light-sensitive emulsion layers of which contain silver halide grains containing at least 80 mol% of chloride, in less than 20 seconds at temperatures of at most 40° C., the images produced being of excellent quality and comparable to images obtained on the same colour negative paper by the RA-4 process in 45 seconds. In particular no concessions have to be made with regard to the light stability of the colours.

The total development time is preferably less than 10 seconds.

After the development the photographic material is stopped, bleached, fixed, washed and dried in the customary manner, it being possible to continue bleaching and fixing in a bleach-fixing operation and to replace the washing process by a stabilising bath. If the bleaching or bleach-fixing bath is sufficiently acidic the stop bath can also be dispensed with.

EXAMPLE

Comparative development:

A commercially customary colour paper based on chloride emulsions, for example Kodak 2001 or Agfacolor type 9 is developed according to the specifications of the RA 4 process and then bleach-fixed and washed.

The processing was carried out in the following manner:

| | |
|---|---|
| Developer: | 45 seconds, 35° C. |
| Bleach-fixing bath: | 45 seconds, 35° C. |
| Washing: | 90 seconds, 30° C. |
| Drying. | |
| Composition of the baths | |
| Developer: | |
| triethanolamine | 11.0 ml |
| N,N-diethylhydroxylamine | 5.1 g |
| 4-amino-N-ethyl-N(β-methanesulphonamidoethyl)-n-toluidinesesquisulphate monohydrate | 5.0 |
| potassium chloride | 2.3 g |
| ethylenediamine tetracetic acid | 3.0 g |
| 3,4-dihydroxy-1,2,5-benzenetrisulphonic acid, trisodium salt | 0.6 g |
| potassium carbonate | 25.0 g |
| in addition, customary surface-active agents and optical brighteners. | |
| Water is added to make up 1 liter, pH = 10.04. | |
| Bleach-fixing bath: | |
| Sodium disulphite | 15 g |
| Ammonium thiosulphate | 100 g |
| Ammonium iron ethylenediaminetetraacetic acid | 50 g |
| ethylenediaminetetraacetic acid | 5 g |

-continued

| |
|---|
| The mixture is made up to 1 liter, pH = 6.0. |

After the 45 seconds required solely for development the following maximum densities are obtained:

yellow 243
magenta 247
cyan 249.

DEVELOPMENT ACCORDING TO THE INVENTION

The same photographic material is used as in the comparative test; instead of being treated with the RA-4 developer it is however first treated for 5 seconds at 30° C. with the following solution I:

| | |
|---|---|
| sodium sulphite | 1 g |
| 4-amino-N-ethyl-N-(β-methanesulponamidoethyl)-m-toluidinesesquisulphate monohydrate | 20 g |
| water to make up to 1.000 ml, pH = 5.0. | |

Then the material is subjected to a solution II of the following composition for 3 seconds at 30° C.:

| | |
|---|---|
| tripotassium phosphate | 50 g |
| potassium hydroxide to adjust pH 13 | |
| Water to make up to 1.000 ml, pH = 13. | |

Then stopping is carried out for 2 seconds and processing is continued in the customary manner.

Maximum densities:

yellow 240
magenta 265
cyan 247.

The comparison of the two development processes shows quite clearly that the development according to the invention effectively produces the required maximum densities in a total development time of only 8 seconds and that the values obtained are to some extent higher than those of the RA-4 process.

I claim:

1. Process for the rapid development of imagewise exposed silver halide recording materials which contain on a layer support at least three light-sensitive silver halide emulsion layers of different spectral sensitivity, with which a cyan coupler, a magenta coupler and a yellow coupler are in each case spectrally associated, comprising the following treatment steps:

1. treatment of the photographic material with a solution I of a color developing agent or a salt thereof at pH 1 to 8 over a period of 1 to 10 seconds,
2. treatment of the photographic material impregnated with the developing agent with a alkali-containing solution II at pH 10 to 14 over a period of 1 to 10 seconds.

2. Process according to claim 1, wherein the silver halide emulsion layers of the photographic recording material to be developed contain at least 80 mol% of chloride.

3. Process according to claim 1, wherein the silver halide emulsion layers of the photographic material to be developed contain at least 95 mol% of chloride.

4. Process according to claim 1, wherein the development is completed in a maximum of 20 seconds.

5. Process according to claim 1, wherein the development is completed in a maximum of 10 seconds.

6. Process according to claim 1, wherin the developer solution 1 contains no benzyl alcohol.

7. Process according to claim 1, wherein the development in both development baths takes place at temperatures in the range of 20° to 40° C.

8. Process according to claim 1, wherein the developing agent is applied in an amount of from 5 to 100 g/l.

* * * * *